US007214648B2

(12) United States Patent
Saini et al.

(10) Patent No.: US 7,214,648 B2
(45) **Date of Patent: *May 8, 2007**

(54) LUBRICANT AND ADDITIVE FORMULATION

(75) Inventors: Mandeep S. Saini, Lexington, KY (US); Thomas R. Smith, Lexington, KY (US); Michael A. Dituro, Huntington, WV (US); Richard J. Baumgart, Paris, KY (US); Frances E. Lockwood, Georgetown, KY (US)

(73) Assignee: Ashland Licensing and Intellectual Property, LLC, Dublin, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/208,715

(22) Filed: Jul. 29, 2002

(65) Prior Publication Data

US 2003/0119682 A1 Jun. 26, 2003

Related U.S. Application Data

(63) Continuation-in-part of application No. 09/520,738, filed on Mar. 7, 2000, now abandoned, and a continuation-in-part of application No. 08/836,083, filed on Aug. 27, 1997, now Pat. No. 6,034,038.

(51) Int. Cl.
*C10M 141/12* (2006.01)
*C10M 157/00* (2006.01)

(52) U.S. Cl. ..... 508/167; 508/185; 508/272; 508/279; 508/280; 508/363; 508/379; 508/388; 508/469; 508/472; 508/482; 508/584; 508/591

(58) Field of Classification Search ..... 508/167, 508/185

See application file for complete search history.

(56) References Cited

U.S. PATENT DOCUMENTS

| | | | | |
|---|---|---|---|---|
| 4,029,587 | A * | 6/1977 | Koch | 508/303 |
| 4,116,877 | A * | 9/1978 | Outten et al. | 252/72 |
| 4,844,829 | A * | 7/1989 | Wilburn et al. | 508/469 |
| 5,458,807 | A * | 10/1995 | Tamoto | 508/192 |
| 5,629,272 | A * | 5/1997 | Nakazato et al. | 508/185 |
| 5,641,731 | A * | 6/1997 | Baumgart et al. | 508/183 |

(Continued)

FOREIGN PATENT DOCUMENTS

| | | |
|---|---|---|
| EP | 0609623 A1 | 8/1994 |
| WO | WO 95/10584 | 4/1995 |

*Primary Examiner*—Ellen M. McAvoy
(74) *Attorney, Agent, or Firm*—Carrithers Law Office PLLC; David W. Carrithers

(57) ABSTRACT

An engine lubricant formulated as a complete crankcase motor oil or additive concentrate composed of a combination of chemical constituents including a base oil selected from a synthetic oil, a mineral oil or semi-synthetic base oil (hydrogenated oil) or combination thereof, an oil soluble molybdenum additive, a dispersant inhibitor containing zinc dithiophosphate, and viscosity index improvers and one or more seal swelling agents to lubricate the engine and recondition the seals of new and/or high mileage engines. Addition of a polyalphaolefin and/or one or more esters such as a diester or polyolester may also be utilized therein. The lubricant may be formulated as a complete engine oil crankcase lubricant, or concentrated into an additive for addition to conventional mineral oil based engine oil, synthetic engine oils, or blends thereof in an effective amount of up to 30 percent volume percent, typically from 20 to 25 percent by volume.

2 Claims, 3 Drawing Sheets

U.S. PATENT DOCUMENTS 5,739,088 A * 4/1998 Inoue et al. ..... 508/156
5,763,369 A * 6/1998 Baumgart et al. ..... 508/183
5,962,377 A * 10/1999 Baumgart et al. ..... 508/168
6,034,038 A * 3/2000 Lockwood et al. ..... 508/183
6,423,670 B2 * 7/2002 Locke et al. ..... 508/192

* cited by examiner

LUBRICANT AND ADDITIVE FORMULATION

BACKGROUND OF THE INVENTION

This is a Continuation-In-Part application of U.S. application Ser. No. 09/520,738 filed on Mar. 7, 2000, now abandoned filed as a Continuation-In-Part of U.S. Pat. No. 6,034,038 which issued on Mar. 7, 2000 from U.S. application Ser. No. 08/836,083 filed on Aug. 27, 1997 as a national application of PCT/US96/14186 claiming priority from U.S. Pat. No. 5,763,369 which issued on Jun. 9, 1998 from application Ser. No. 08/334,513 filed on Nov. 4, 1994 and U.S. Pat. No. 5,641,731 from U.S. application Ser. No. 08/455,353 filed on May 31, 1995 and U.S. Pat. No. 5,962, 377 which issued on Oct. 5, 1999 from U.S. application Ser. No. 881,415 on Jun. 24, 1997 all of which are incorporated by reference herein.

TECHNICAL FIELD

The invention relates to the general field of an improved motor oil lubricant. The lubricant may be formulated as a 100% complete engine oil crankcase lubricant, or concentrated into an additive for addition to conventional mineral oil based engine oil, synthetic engine oils, or blends thereof in an effective amount of up to 30 percent volume percent, typical from 20 to 25 percent by volume. The invention is formulated to include selected seal swelling agents to recondition and maintain seals in new engines and/or more particularly high mileage engines.

A preferred embodiment of the present invention comprises effective amounts of a combination of chemical constituents including an oil soluble molybdenum additive, base oil (synthetic, mineral, and/or Group III semi-synthetics), a dispersant inhibitor containing zinc dithiophosphate, and viscosity index improvers. Seal swelling agents may be selected from aryl esters, alkly esters, vegetable based esters, sulfolanes, sulfolane derivatives, phenates, phthalate plasticizers like phthalate plasticizers, more particularly dioctyl phthalate, dinonly phthalate or dihexylpthalate, or other plasticizers. Addition of selected synthetics such as polyalphaolefin and/or esters such as a diester or polyolester, and/or a antiwear/extreme pressure agent such as a metal containing borate compound such as a borate ester, may be used to formulate one or more embodiments of the additive in combination with a conventional crankcase lubricant containing mineral oil, synthetic oil, semi-synthetic, or combinations thereof up to 50 volume percent and more preferably from about 10 to 40 volume percent, more preferably from about 15 to 30 percent and most preferably from about 20 to about a 25% volume/percent after dilution with motor oil, wherein typically 1 quart is blended with 4 or 5 quarts of motor oil. The various constituents are preblended and/or sold as a complete motor oil formulation.

DESCRIPTION OF THE PRIOR ART

Lubrication involves the process of friction reduction, accomplished by maintaining a film of a lubricant between surfaces which are moving with respect to each other. The lubricant prevents contact of the moving surfaces, thus greatly lowering the coefficient of friction. In addition to this function, the lubricant also can be called upon to perform heat removal, containment of contaminants, and other important functions. Additives have been developed to establish or enhance various properties of lubricants. Various additives which are used include viscosity improvers, detergents, dispersants, antioxidants, extreme pressure additives, and corrosion inhibitors.

Anti-wear agents, many of which function by a process of interactions with the surfaces, provide a chemical film which prevents metal-to-metal contact under high load conditions. Wear inhibitors which are useful under extremely high load conditions are frequently called "extreme pressure agents". Certain of these materials, however, must be used judiciously in certain applications due to their property of accelerating corrosion of metal parts, such as bearings. The instant invention utilizes several chemical constituents to provide an additive formula which enhance the performance of conventional engine oil and inhibits the undesirable side effects which may be attributable to use of one of more of the chemical constituents when used at particular concentrations.

Several references teach the use of individual chemical components to enhance the performance of conventional engine oil. For instance, U.S. Pat. No. 4,879,045 by Eggerichs adds lithium soap to a synthetic base oil comprising diester oil and polyalphaolefins which can comprise an aliphatic diester of a carboxylic acid such as di-2-ethylhexylazelate, di-isodecyladipate, or ditridecyladipate, as set forth in the *Encyclopedia of Chemical Technology,* 34th addition, volume 14, pp 477–526, which describes lubricant additives including detergent-dispersant, viscosity index (VI) improvers, foam inhibitors, and the like.

Futhermore Cusumano et al teaches in U.S. Pat. No. 5,696,064 the functionaliztion of polymers based on KOCK chemistry and derivatives which may be used in the oil industry. Outten et al. in U.S. Pat. No. 4,116,877 teaches elastomers for compatible seal swell additives for automotive transmission fluids; Arai et al. in U.S. Pat. No. 5,356, 547 teaches lubricating oil compositions containing friction modifiers and corrosion inhibitors; and Koch in U.S. Pat. No. 4,029,587 teaches lubricants and functional fluids containing substituted sulfolanes as seal swelling agents. However, none of the references alone or together teach the instant engine oil composition especially developed for conditioning seals.

SUMMARY OF THE INVENTION

The present invention comprises various formulations of an engine crankcase oil formula including selected seal swelling agents to recondition the rubber and elastomer components within the engine and includes a formula for an additive concentrates for addition to engine oil having a mineral oil base, a synthetic oil base, or blends thereof for improving the lubricating properties of the engine oil, enhance the performance of the engine, and reduce consumption of the oil.

One preferred embodiment of the engine crankcase lubricant and additive comprises a blend of chemical constituents including an oil soluble molybdenum additive, a dispersant inhibitor containing zinc dithiophosphate, and a viscosity index improvers in a synthetic, mineral oil, semi-synthetic hydrogenated base stock or combinations and blends thereof. An ester such as a diester, and/or a polyolester may be utilized therewith. A metal containing borate compound such as a borate ester or other compound may be added optionally as a corrosion inhibitor for yellow metals. Alternate corrosion inhibitors may be selected from dimercapto, thiediapoles, or benztriazoles. The seal swelling compound is added to provide a formulation for use with older engines to aid in reconditioning and maintaining the seals. The constituents may be combined to give particular performance properties for formulating various embodiments of the lubricant additive concentrate for use with conventional crankcase engine oil or the formulation of a complete engine oil incorporating the additive concentrate package. The additive is used in an effective amount in combination with a conventional crankcase lubricant containing mineral oil, synthetic oil or combinations thereof up to about 30 percent by volume, more preferably from about 15 to 30 percent by volume, and most preferably from about 20 to about a 25% volume/percent.

Another preferred embodiment of the engine treatment oil additive comprises a blend of chemical constituents including an oil soluble molybdenum additive, a synthetic, mineral, or Group III semi-synthetic base oil. Moreover, a dispersant inhibitor containing zinc dithiophosphate, a seal swelling agent, and viscosity index improvers are blended together and added thereto. An extreme pressure antiwear agent such as a borate compound may also be utilized in the present composition.

The individual components can be separately blended into the base fluid or can be blended therein in various subcombinations. Moreover, the components can be blended in the form of separate solutions in a diluent. Blending the components used in the form of an oil additive concentrate simplifies the blending operations, reduces the likelihood of blending errors, and takes advantage of the compatibility and solubility characteristics afforded by the overall concentrate. Of course, the preblended complete motor oil is convenient to use and is often preferable for adding to an engine one quart or less at a time such as for routine maintenance of older cars having engine wear and requiring additional motor oil lubricant between oil changes. The complete motor oil does not require the consumer to determine the amount of additive required for optional performance when blending with a conventional motor oil in small quantifies between oil changes.

The combination of chemical constituents of the present invention are not disclosed by any known prior art references. The incorporation of molybdenum compounds, extreme antiwear compounds such as boric acid agents provide improved performance to motor oil and greases. Moreover, the incorporation of semi-synthetic oils defined by the American Petroleum Institute (API) as severely hydro cracked oils) provide an means to reduce the cost of lubricating oils while maintaining many of the desirable characteristics of synthetic oil.

These lubricating compositions are effective in a variety of applications including crankcase lubricating oils for spark-ignited and compression-ignited internal combustion engines, two-cycle engines, aviation piston engines, marine and low-load diesel engines, and the like. The invention will find use in a wide variety of lubricants, including motor oils, greases, sucker-rod lubricants, cutting fluids, and even spray-tube lubricants. The invention has the multiple advantages of saving energy, reducing engine or other hardware maintenance and wear, and therefore, provides an economical solution to many lubricating problems commonly encountered in industry or consumer markets. It is also contemplated that the formulation may be applicable to automatic transmission fluids, transaxle lubricants, gear lubricants, hydraulic fluids, and other lubricating oil compositions which can benefit from the incorporation of the compositions of the instant invention.

More particularly, one preferred concentrate for addition to conventional motor oil for improving the lubricating properties of the motor oil and enhancing the performance of the engine comprises the following chemical constituents: an oil soluble molybdenum additive, a ("synthetic base") such as polyalphaolefin (PAO), a synthetic polyolester, and/or a synthetic diester, a Dispersant Inhibitor (DI) package containing zinc dithiophosphate (ZDP) and which may also contain a detergent and/or corrosion inhibitor, such as CHEMALOY D-036; a Mineral Oil Base Stock; and a Viscosity Index Improver, such as for example, (SHELLVIS 90-SBR); and an extreme anti-wear agent (borate ester). The addition of a seal swelling agent such as a substituted sulfolane provides conditions the seal for additional protection and increased performance characteristics.

Finally, a preferred composition of the instant invention provides improved lubricating properties and comprises a lubricant concentrate for dilution with conventional, synthetic blend, and/or fully synthetic motor oil comprising in combination: an effective amount of an oil soluble molybdenum additive; an effective amount of a base oil selected from the group consisting of a synthetic base oil, a mineral oil, a severely hydro cracked oil, alone and in combination one with another; and an effective amount of less than 1000 ppm of an elemental boron. Moreover, a lubricating composition comprising a major amount of an oil of lubricating viscosity and a minor amount of the concentrate aforementioned concentrate additive provides a complete motor oil with improved lubricating properties.

The incorporation of severly cracked hydrogenated oils provide an means to reduce the cost of synthetic oils while maintaining many of the desirable characteristics. Finally, addition of seal swelling compounds in the precise proportions provides a means to lubricant, soften, and revitalize seals for reducing oil consumption and pollution generated thereby.

These lubricating compositions are effective in a variety of applications including crankcase lubricating oils for spark-ignited and compression-ignited internal combustion engines, two-cycle engines, aviation piston engines, marine and low-load diesel engines.

More particularly, a preferred concentrate for addition to conventional motor oil for improving the lubricating properties of the motor oil and enhancing the performance of the engine comprises the following chemical constituents: an oil soluble molybdenum additive, a mineral oil or semi-synthetic base oil having a selected viscosity, a Dispersant Inhibitor (DI) package containing zinc dithiophosphate (ZDP) and which may also contain a detergent and/or corrosion inhibitor, a viscosity index improver, and corrosion inhibitor. The addition of a seal swelling compound provides additional protection and increased performance characteristics.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
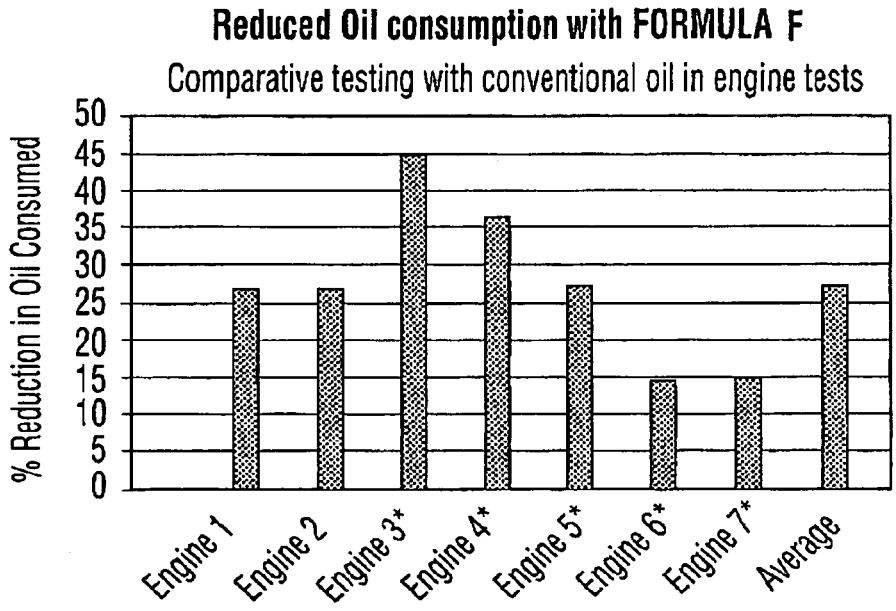
FIG. 1 is a graph showing reduced oil consumption using the motor oil composition of the present invention.

Each of the preferred ingredients of the engine treatment oil additive formulation, whether mandatory or optional, is discussed below:

Oil Base Stocks

The complete motor oil formula and/or the concentrated additive contains preferably up to 95 percent by volume, more preferably from about 10 to about 95 percent by volume, more preferably from about 25 to about 90 percent by volume, more preferably from about 40 to about 85% by volume, and most preferably from about 55 to 75 percent by volume of a base stock composed of a mineral oil base stock, a severely hydrocracked oil base stock, and/or a synthetic base alone or blended together, and/or the following base stocks defined as Group I (solvent refined mineral oils), Group II (hydro cracked mineral oils), Group III (severely hydro cracked oil) ; Group IV (polyolefins), and Group V (esters, and napthenes). Typically the base oils from Groups III, IV and V together with additives are deemed synthetic oils. As used in the instant application, oils from Group III are deemed severly hydro cracked (semi-synthetic) base oils.

Synthetic Base Stock

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-octenes), poly(1-decenes), etc., and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.), alkylated diphenyl, ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol either having an average molecular weight of 1000, diphenyl either of polyethylene glycol have a molecular weight of 500–1000, diethyl ether of polypropylene glycol having a molecular weight of 1000–1500, etc.) or mono- and polycarboxylic esters thereof, for example, the acetic acid esters, mixed $C_3$-C-$_8$ fatty acid esters, esters, or the $C_{13}$0×0 acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, alkenyl malonic acids, etc.) with a variety of alcohols (e.g., butyl alcohol, hexyl alcohol, dodecyl alcohol, 2-ethylhexyl alcohol, ethylene glycol diethylene glycol monoether, propylene glycol, etc.). Specific examples of these esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

The concentrate additive and/or complete motor oil contains preferably up to 95 percent by volume, more preferably from about 10 to about 95 percent by volume, more preferably from about 25 to about 90 percent by volume, more preferably from about 40 to about 85% by volume, and most preferably from about 55 to 75 percent by volume of a synthetic, Group III severely hydro cracked (semi-synthetic), and/or mineral oil base stock used alone or blended together as a base stock.

One preferred synthetic base stock comprises at least a significant portion of a polyalphaolefin.

Polyalphaolefin (PAO)

Although not essential, the preferred synthetic base stock comprises at least a significant portion of a polyalphaolefin. Polyalphaolefin, ("PAO"), is a synthetic fluid effective at high temperatures, such as occurs during operation of internal combustion engines. It is also very effective at low temperatures. It is especially effective in the presence of diesters. Polyalphaolefin provides superior oxidation and hydrolytic stability and high film strength. Polyalphaolefin also has a high molecular weight, higher flash point, higher fire point, lower volatility, higher viscosity index, and lower pour point than mineral oil. U.S. Pat. No. 4,859,352 hereby incorporated by reference provides additional polyalphaolefin derivatives.

Preferred polyalphaolefins, ("PAO"), include those sold by EXXON-MOBIL USA as SHF fluids and those sold by Ethyl Corporation under the name ETHYLFLO, or ("ALBERMARLE"). PAO's include the ETHYL-FLOW series by Ethyl Corporation, "Albermarle Corporation", including ETHYL-FLOW 162, 164, 166, 168, and 174, having varying viscosities from about 2 to about 460 centistoke. Also useful are blends of about 56% of the 460 centistoke product and about 44% of the 45 centistoke product as set forth in U.S. Pat. No. 5,348,668 hereby incorporated by reference.

MOBIL SHF-42 from EXXON-MOBIL USA, EMERY 3004 and 3006, Equilon, and Quantum Chemical Company provide additional polyalphaolefins base stocks. For instance, EMERY 3004 polyalphaolefin has a viscosity of 3.86 centistokes (cSt) at 212 F. (100 C.) and 16.75 cSt at +104 F. (40 C.). It has a viscosity index of 125 and a pour point of −98 F and it also has a flash point of +432 F. and a fire point of +478 F. Moreover, EMERY 3006 polyalphaolefin has a viscosity of 5.88 cSt at +212 F. and 31.22 cSt at +104 F. It has a viscosity index of 135 and a pour point of −87 F. It also has a flash point of +464 F. and a fire point of +514 F.

Additional satisfactory polyalphaolefins are those sold by Uniroyal Inc. under the brand SYNTON PAO-40, which is a 40 centistoke polyalphaolefin. Also useful are the ORONITE brand polyalphaolefins manufactured by CHEVRON-TEXACO Chemical Company.

It is contemplated that GULF SYNFLUID 4 cSt PAO, commercially available from Gulf Oil Chemicals Company, a subsidiary of CHEVRON-TEXACO Corporation, which is similar in many respects to EMERY 3004 may also be utilized herein. MOBIL SHF-41 PAO, commercially available from EXXON-MOBIL Chemical Corporation, is also similar in many respects to EMERY 3004.

Preferably the polyalphaolefins will have a viscosity of up to 100 centistoke and more typically in the range of about 2–10 centistoke at 100° C. with viscosities of 4 and 6 centistoke being particularly preferred.

Moreover, a preferred embodiment may incorporate up to 95 percent by volume, more preferably from 10 to 90 percent by volume, and more preferably from about 40 to 85 percent by volume of polyalphaolefins having a viscosity of about 4 cSt at 100° C. such as is available from Ethyl Corporation under the trademark name of DURASYN 164.

A preferred concentrate embodiment may incorporate up to 85 percent by volume, more preferably from 5 to 85 percent by volume, more preferably from about 10 to 60 percent by volume, and most preferably from 10 to 30 percent by volume of polyalphaolefins having a viscosity of about 6 cSt at 100° C. such as is available from Ethyl Corporation under the trademark name of DURASYN 166.

Moreover, an even more preferred embodiment of the present invention further providing even more enhanced performance characteristics utilizes synthetics which include a specific portion comprising esters, polyesters, or combinations thereof. One preferred embodiment utilizes polyolefins as the synthetic base stock together with at least a portion comprising esters and/or polyesters.

Esters

The most preferred synthetic based oil ester additives are polyolesters and diesters such as di-aliphatic diesters of alkyl carboxylic acids such as di-2-ethylhexylazelate, di-isodecyladipate, and di-tridecyladipate, commercially available under the brand name EMERY 2960 by Emery Chemicals, described in U.S. Pat. No. 4,859,352 to Waynick. Other suitable polyolesters are manufactured by EXXON-MOBIL Oil. Exxon-Mobil polyolester P-43, NP343 containing two alcohols, M-045, and Hatco Corp. 2939 are particularly preferred.

Diesters and other synthetic oils have been used as replacements of mineral oil in fluid lubricants. Diesters have outstanding extreme low temperature flow properties and good residence to oxidative breakdown.

The diester oil may include an aliphatic diester of a dicarboxylic acid, or the diester oil can comprise a dialkyl aliphatic diester of an alkyl dicarboxylic acid, such as di-2-ethyl hexyl azelate, di-isodecyl azelate, di-tridecyl azelate, di-isodecyl adipate, di-tridecyl adipate. For instance, Di-2-ethyl hexyl azelate is commercially available under the brand name of EMERY 2958 by Emery Chemicals.

Also useful are polyol esters such as EMERY 2935, 2936, and 2939 from Emery Group of Henkel Corporation and HATCO 2352, 2962, 2925, 2938, 2939, 2970, 3178, and 4322 polyol esters from Hatco Corporation, described in U.S. Pat. No. 5,344,579 to Ohtani et al. and MOBIL ester P 24 from EXXON-MOBIL USA. EXXON-MOBIL esters such as made by reacting dicarboxylic acids, glycols, and either monobasic acids or monohydric alcohols like EMERY 2936 synthetic-lubricant base stocks from Quantum Chemical Corporation and MOBIL P 24 from EXXON-MOBIL USA can be used. Polyol esters have good oxidation and hydrolytic stability. The polyol ester for use herein preferably has a pour point of about −100° C. or lower to −40° C. and a viscosity of about 2–460 centistoke at 100° C.

Although not essential, a preferred additive concentrate and/or motor oil comprises at least a portion of a ester. The concentrate additive and/or complete motor oil contains preferably up to 25 percent by volume, more preferably from about 5 to about 20 percent by volume, more preferably from about 5 to about 15 percent by volume, of a polyester or diester such as obtained from EMERY under the trademark 2960.

Severely Hydro Cracked Oils

A hydrogenated oil is a mineral oil subjected to hydrogenation or hydrocracking under special conditions to remove undesirable chemical compositions and impurities resulting in a base oil having synthetic oil components and properties. Typically the hydrogenated oil is defined by the American Petroleum Institute (API) as a Group III petroleum based stock with a sulfur level less than 0.03 with saturates greater than or equal to 90 and a viscosity index of greater than or equal to 120 may optionally be utilized in amounts up to 95 percent by volume, more preferably from 5.0 to 50 percent by volume and more preferably from 20 to 40 percent by volume when used alone or in combination with a synthetic or mineral oil.

The hydrogenated oil may be used as the sole base oil component of the instant invention providing superior performance to conventional motor oils with no other synthetic oil base or mineral oil base or used as a blend with mineral oil and/or synthetic oil. An example of such an oil is YUBASE-4. Other suppliers include CHEVRON-TEXACO Company. A complete motor oil or an additive concentrate embodiment may incorporate up to 95 percent by volume, more preferably from 5 to 85 percent by volume of the semi-synthetic as the oil base stock. When used in combination with another conventional synthetic oil such as those containing polyolefins or esters, or when used in combination with a mineral oil, the hydrogenated oil may be present in an amount of up to 95 percent by volume, more preferably from about 10 to 80 percent by volume, more preferably from 20 to 60 percent by volume and most preferably from 10 to 30 percent by volume of the base oil composition.

More particularly, the hydrogenated oil is a base oil for a lubricating oil consisting of a mineral oil and/or a synthetic oil, having a viscosity index of at least 120, and having a viscosity of from 2 to 3,000 CST at 100 degrees C. Hydrogenated oils can be obtained by subjecting raw materials for lubricating oils to hydrogenation treatment, using a hydrogenation catalyst such as cobalt or molybdenum with a silica-alumina carrier, and lubricating oil factions which can be obtained by the isomerization of waxes. The hydro cracked or wax-isomerized oils contain 90 percent by weight or greater of saturates and 300 ppm or less of sulfur.

Mineral Oil Base Stock

Although not essential, a mineral oil base stock may be incorporated in the present invention as a portion of the concentrate or a base stock to which the concentrate may be added to produce a motor oil. Particularly preferred as mineral oil base stocks are the ASHLAND 325 Neutral defined as a solvent refined neutral having a SABOLT UNIVERSAL of 325 SUS @ 100° F. and ASHLAND 100

Neutral defined as a solvent refined neutral having a SABOLT UNIVERSAL of 100 SUS @ 100° F., manufactured by MARATHON ASHLAND PETROLEUM and by others.

Other acceptable petroleum-base fluid compositions include white mineral, paraffinic and MVI naphthenic oils having the viscosity range of about 20–400 Centistoke. Preferred white mineral oils include those available from WITCO Corporation, ARCO BP Chemical Company, PSI and PENRECO. Preferred paraffinic oils include API Group I and Group II oils available from EXXON MOBIL USA, Group II oils available from MOTIVA ENTERPRISES, LLC., and Group II oils available from CHEVRON EXXON Corp. Preferred MVI naphthenic oils include solvent extracted oils available from EQUILON ENTERPRISES and SAN JOAQUIN REFINING, hydro treated oils available form EQUILON ENTERPRISES, and naphthenic oils sold under the names HYDROCAL and CALSOL by CALUMET, and naphthenic oils such as are described in U.S. Pat. No. 5,348,668 to Oldiges.

Mineral oil base stock can comprise the entire base oil typically up to 95% by volume, more preferably 5–85 percent by volume, more preferably 50–80 percent by volume and most preferably 70–80 percent by volume in the complete motor oil, but is not narrowly critical. More particularly, the mineral oil base stock can be used up to about 95 percent in the concentrate and up to 50 percent and preferably up to about 35 percent by volume of the motor engine oil upon dilution. Typically one unit of the concentrate is diluted with about 4 or 5 units of the motor oil which may be a fully synthetic, mineral oil, or blend.

Dispersant Inhibitor (DI)

Though not narrowly critical, the Dispersant Inhibitor ("DI")), is exemplified by those which contain alkyl zinc dithiophosphates, succinimides, esters, or Mannich dispersant, calcium, magnesium, sodium sulfonates, phenates, phenolic and amine antioxidants, plus various friction modifiers such as sulfurized fatty acids. Dispersant inhibitors are readily available from Lubrizol, Ethyl, Oronite, a division of CHEVRON-TEXACO Chemical, and INFINEUM.

Generally acceptable are those commercial detergent inhibitor packages used in formulated engine oils meeting the API SH CD or higher performance specifications. Particularly preferred are dispersants such as LUBRIZOL 8955 having chemical and physical properties such as those described in U.S. Pat. No. 5,490,945 of the Lubrizol Corporation which is hereby incorporated by reference, ETHYL HITEC 1111 and 1131, and similar formulations available from INFINEUM, or Oronite, a division of CHEVRON-TEXACO Chemical.

An effective amount of an additive package which incorporates a dispersion inhibitor such as the one listed heretofore may also be utilized and include a conventional detergent and/or a corrosion inhibitor. Such an additive package may be utilized with or in substitution of a selected dispersion inhibitor or combinations thereof with each other and/or other dispersion inhibitors commercially available in an effective amount of up to 35 percent by volume, more preferably from about 0.5 to 25 percent by volume and more preferably from about 1 to 15 percent by volume of the complete motor oil formula and up to 6× that amount in the concentrate. The DI concentration is generally up to 15% by volume of the total formulation of the complete engine oil and more particularly from 5.0 to 15% by volume. Concentrations produced for dilution will generally be in these ranges.

Zinc dithiophosphate is a multi-function additive in that it functions as a corrosion inhibitor, antiwear agent, and antioxidants added to organic materials to retard oxidation.

Other metal dithiophosphates such as zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl) dithiophosphate, calcium di(hexyl) dithiophosphate, zinc isobutyl isoamyl dithiophosphate, and zinc isopropyl secondary-butyl dithiophosphate may be applicable. These metal salts of phosphorus acid esters are typically prepared by reacting the metal base with the phosphorus acid ester such as set forth in U.S. Pat. No. 5,354,485 hereby incorporated by reference. Moreover, a preferred dispersion inhibitor is described in U.S. Pat. No. 5,490,945 hereby incorporated by reference which describes a compound containing at least one carboxylic derivative composition produced by reacting at least one substituted succinic acylating agent containing at least about 50 carbon atoms in the substituent with at least one amine compound containing at least one HN<group.

Pour Point Depressant

A pour point depressant in an effective amount of up to 10.0 volume percent of the complete engine oil formula and more preferably about 0.01 to 5.0 percent by weight and most preferably from about 0.1 to 1.0 percent by weight is not essential but can be utilized an embodiment of the formulation. Of course, a sufficient amount of the viscosity improver may also be incorporated in the base oils or motor oil to be treated. Also the pour point depressant is typically not concentrated 4× or 5× in the additive package. An example of a suitable pour point depressant is polymethacyrlate, alkylated bicyclic aromatics, styrene esters, polyfumerates, oligomerized alky phenols, dialkyl esters of phthalate acid, ethylene vinyl acetate copolymers, and other mixed hydrocarbon polymers from LUBRIZOL, the ETHYL Corporation, or ROHMAX, a Division of Degussa. A commercially available pour point depressant is sold under the brand name of ACRYLOID 3008 which is a polymethyrlate formula.

Seal Swelling Constituents

Seal swelling agents may be selected from aryl esters, alkly esters, vegetable based esters, sulfolanes, sulfolane derivitives, phenates, phthalate plasticizers like phthalate plasticizers, more particularly dioctyl phthalate, dinonly phthalate or dihexylpthalate, or other plasticizers. A seal swelling constituent such as a substituted sulfolane from LUBRIZOL, Inc., ETHYL Corp., for example LZ730 can be used in an effective amount up to 1.0 volume percent, and more preferably from about 0.03 to 1.0 percent by weight of the complete motor oil formula and up to 5× that amount in the concentrate. Other seal swelling compositions including 3-alkoxysulfolane or the like, in which the alkoxy group contains at least about 4 and preferably about 4–25 carbon atoms, are described in U.S. Pat. Nos. 4,029,587 and 4,116,877 hereby incorporated by reference.

The sulfolane compounds and particularly the substituted sulfolanes, are a preferred seal swelling component in the compositions of the instant invention.

More particularly, seal swelling constiuents suitable in the present invention include 3-isodecoxysulfolane, and other substituted sulfolanes including those having: 1) A hydrocarbon-based radical having at least about 4 carbon atoms such as aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like. Examples include butyl, pentyl, hexyl, octyl, decyl, dodecyl, eicosyl, decenyl, cyclohexyl, phenyl, tolyl, heptylphenyl, isopropenylphenyl and naphthyl; 2) Substituted hydrocarbon radicals containing non-hydrocarbon substituents which, do not alter the predominantly hydrocarbon character of the radical such as halo, nitro, and cyano compounds; and 3) Hetero radicals which are hydrocarbons which contain atoms other than carbon present in a chain or ring otherwise composed of carbon atoms such as oxygen, nitrogen and sulfur.

Other preferred substituted sulfolanes are those in which a hydrocarbon radical is selected free from acetylenic unsaturation and which contains about 4–100 carbon atoms. Examples (all isomers being included) are butyl, amyl, hexyl, octyl, decyl, dodecyl, eicosyl, triacontanyl, butenyl, dodecenyl, phenyl, naphthyl, tolyl, dodecylphenyl, tetrapropene-alkylated phenyl, phenethyl, cyclohexyl and methylcyclohexyl. Each of substituted hydrocarbon radicals and hetero radicals are hydrogen or a lower alkylbased (and usually a lower alkyl) radical, the word "lower" denoting radicals containing up to 7 carbon atoms. Examples of lower alkyl radicals (all isomers being included, but especially the straight chain radicals) are methyl, ethyl, propyl, butyl and hexyl, with methyl being preferred.

The above-described substituted sulfolanes comprise a class of compounds which may be prepared by the reaction of 3-sulfolene or a substituted derivative thereof with an organic hydroxy compound, ordinarily an alcohol. This method for their preparation is described, for example, in U.S. Pat. No. 2,393,925, and in Data Sheet DS-58:3 of Shell Development Company entitled "3-Sulfolene". The 3-sulfolenes may be prepared by reaction of sulfur dioxide with a conjugated diene such as butadiene or isoprene.

Moreover, aliphatic alcohols of 8 to 13 carbon atoms, e.g., tridecyl alcohol in combination with an oil-soluble, saturated hydrocarbyl ester of 10 to 60 carbon atoms and 2 to 3 ester linkages, e.g., dihexyl phthalate are useful.

Furthermore, C1-C8 alkyl substituted phosphites, C1 to C4 alkyl substituted phenols or aromatic secondary amine and a dispersant copolymer containing N-vinyl-2-pyrrolidone, an organophosphite, such as tris(nonylphenyl) phosphite and mixtures of organic phosphite ester and methylened bisphenol are useful for oxidation inhibitors for lubricating oils and for elastomers, including nitrile rubbers.

Additive Packages

Additive packages which incorporate a dispersion inhibitor with a conventional detergent and/or a corrosion inhibitor may also be utilized with or in substitution of the dispersion inhibitor. For instance as set forth heretofore, such an additive package may comprise Lubrizol's LZ8955 and/or LZ9802 or combinations thereof with each other and/or other dispersion inhibitors in an effective amount of up to 35 percent by volume, more preferably from about 0.5 to 25 percent by volume and more preferably from about 1 to 10 percent by volume of the concentrate.

Because the base oils typically contain an effective amount of a pour point depressant and/or the motor oil to which the additive is added typically contain an effective amount of a pour point depressant, it would not typically be concentrated 4× or 5× in the additive package.

Viscosity Index Improver (VI)

Viscosity improvers, ("VI"), include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers and SHELLVIS 90, a linear styrene isoprene rubber in mineral oil base or SHELLVIS 260 a cyclic styrene isoprene compound.

The lubricant additive contain up to 15 percent by volume of a viscosity improver, more preferably from about 0.005–10 percent by volume, more preferably 0.05 to 8 and more preferably from 0.1 to 1.0 percent by volume. Of course, a sufficient amount of the viscosity improver may also be incorporated in the base oils or motor oil to be treated.

Molybdenum Additive

The most preferred molybdenum additive is an oil-soluble decomposable organo molybdenum compound, such as MOLYVAN 855 which is an oil soluble secondary diarylamine defined as substantially free of active phosphorus and active sulfur. The MOLYVAN 855 is described in Vanderbilt's Material Data and Safety Sheet as a organomolybdenum compound having a density of 1.04 and viscosity at 100° C. of 47.12 cSt. In general, the organo molybdenum compounds are preferred because of their superior solubility and effectiveness.

A less effective alternative molybdenum additive is MOLYVAN L is sulfonated oxymolybdenum dialkyldithiophosphate described in U.S. Pat. No. 5,055,174 by Howell hereby incorporated by reference.

MOLYVAN A made by R. T. Vanderbilt company, Inc., New York, N.Y., USA, is also an alternative additive which contains about 28.8 wt. % MO, 31.6 wt. % C, 5.4 wt. % H., and 25.9 wt. % S. Also useful are MOLYVAN 855, 822, 856, and 807 in decreasing order of preference.

Also useful is SAKURA LUBE-500, which is more soluble Mo dithiocarbamate containing lubricant additive obtained from Asahi Denki Corporation and comprised of about 20.2 wt. % MO, 43.8 wt. % C, 7.4 wt. % H, and 22.4 wt. % S.

Also useful is MOLYVAN 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R. T. Vanderbilt and marketed as an antioxidant and antiwear additive.

Other sources are molybdenum $Mo(Co)_6$, and Molybdenum octoate, $MoO(C_7H_{15}CO_2)_2$ containing about 8 wt-% Mo marketed by Aldrich Chemical Company, Milwaukee, Wis. and molybdenum naphthenethioctoate marketed by Shephard Chemical Company, Cincinnati, Ohio.

Inorganic molybdenum compounds such as molybdenum sulfide and molybdenum oxide are substantially less preferred than the organic compounds as described in 855, 822, 856, and 807.

Whereas 1% is equal to 10,000 parts per million (ppm), the preferred dosage in the molybdenum additive is up to 5.0 percent by mass. More preferably the preferred dosage is up to 3,000 ppm by mass, more preferably from about 100 ppm to about 2,000 ppm by mass, more preferably from about 300 to about 1,500 ppm by mass, more preferably from 300 to about 1000 ppm by mass of molybdenum.

Anti-wear Extreme Pressure Agents

The preferred anti-wear extreme pressure agent is a boron antiwear/extreme pressure agent, preferably a borate ester, a boric acid, other boron compounds such as a boron oxide. The boron compound is hydrolytically stable and is utilized for improved antiwear, antiweld, extreme pressure and/or friction properties, and perform as a rust and corrosion inhibitor for copper bearings and other metal engine components. The borated ester compound acts as an inhibitor for corrosion of metal to prevent corrosion of either ferrous or non-ferrous metals (e.g. copper, bronze, brass, titanium, aluminum and the like) or both, present in concentrations in which they are effective in inhibiting corrosion.

Patents describing techniques for making basic salts of sulfonic, carboxylic acids and mixtures thereof include U.S. Pat. Nos. 5,354,485; 2,501,731; 2,616,911; 2,777,874; 3,384,585; 3,320,162; 3,488,284; and 3,629,109. The disclosure of these patents are hereby incorporated by reference. Methods of preparing borated overbased compositions are found in U.S. Pat. Nos. 4,744,920; 4,792,410; and PCT publication WO 88/03144. The disclosure of these references are hereby incorporated by reference. The oil-soluble neutral or basic salts of alkali or alkaline earth metals salts may also be reacted with a boron compound.

The borate ester utilized in the preferred embodiment is manufactured by EXXON-MOBIL USA under the product designation of ("MCP 1286") and MOBIL ADC700. Test data show the viscosity at 100° C. using the D-445 method is 2.9 cSt; the viscosity at 40° C. using the D-445 method is 11.9; the flash point using the D-93 method is 146; the pour point using the D-97 method is −69; and the percent boron as determined by the ICP method is 5.3%.

The preferred dosage of boron compound in the total crankcase lubricant is up to 10.0 volume percent, more preferably from about 0.01 to about 10.0 volume %, more preferably from about 0.01 to about 5 volume %, and most preferably from about 0.1–3.0 volume %. An effective elemental boron range of up to 1000 ppm or less than 1% elemental boron. Thus, a preferred concentration of elemental boron is from 100 to 1000 ppm and more preferably from 100 to 300 ppm and most preferably in one preferred embodiment as set forth in Table 3 about 166 ppm.

Figure 6:
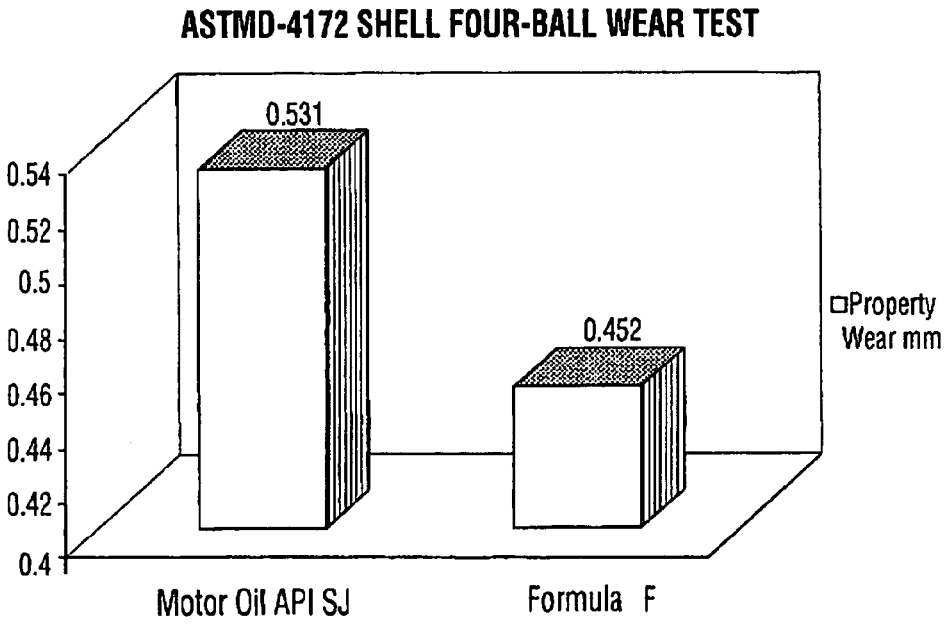
FIG. 6 is a bar chart of ASTM D4172 four-ball wear results versus lube compositions.

As demonstrated in FIG. 6, the engine treatment oil additive formulation was found to comply with all requirements of engine additives specification CRC L-38 for a Crankcase Oxidation Test showing the Total Adjusted Bearing Weight Loss comparing the blend of Components comprising the engine treatment oil additive with an API SG 5w-30 Motor Oil. The surprisingly good results show the total adjusted bearing weight loss was reduced from 30.9 mg for the Motor Oil without the engine treatment oil additive to 22.6 mg. for the motor oil used in combination with the engine treatment oil additive.

Other corrosion resisting compounds which may be used together with boron or independently may be selected from the group comprising dimercapto, thiediapoles, and benzotriazoles, benzotriazole derivatives, benzothiazole, benzothiazole derivatives, triazole, triazole derivatives, benzoimidazole, and benzoiidazole derivitives in levels of to 1% by weight.

Other Additives

The invention also contemplates the use of an effective amount of other additives in the lubricating and functional fluid compositions of this invention. Such additives include, for example, detergents and dispersants of the ash-producing or ashless type, corrosion and oxidation-inhibiting agents, pour point depressing agents, auxiliary extreme pressure and/or antiwear agents, color stabilizers and anti-foam agents.

CRANKCASE MOTOR OIL EXAMPLES

A better understanding of the present invention will be had upon reference to the following examples set forth in Tables I–VII, Formulas A–F) setting forth the compositions of complete crankcase motor oil formulas:

TABLE I

| Test | SAE 5W-30 | SAE 10W-30 | SAE 10W-40 | SAE 20W-50 |
|---|---|---|---|---|
| Vis @ 100° C. (cSt) | 10.6 | 10.5 | 13.5 | 17.4 |
| Spec Gravity @ 60° F. | 0.8655 | 0.878 | 0.877 | 0.8842 |
| Density (lbs/gal) | 7.206 | 7.323 | 7.305 | 7.364 |
| Flash COC (° C.) | 221 | 230 | 242 | 245 |
| Pour Point (° C.) max | −39 | −39 | −39 | −39 |
| CCS cP (° C.) | 2300 @ −25 C. | 2340 @ −20 C. | 2600 @ −20 C. | 2700 @ −10 C. |
| MRV TP-1 cP (° C.) | 17,812 @ −35 C. | 14,361 @ −30 C. | 20,850 @ −30 C. | 22,340 @ −20 C. |
| HTHS, cP | 3.05 | 3.1 | 3.5 | 4.5 |
| Noack (%) max wt. Loss | 14.0 | 14.0 | 14.1 | — |
| Zinc/Phosphorus (wt %) | 0.119/0.1 | 0.119/0.1 | 0.119/0.1 | 0.119/0.1 |
| Calcium/Magnesium (wt %) | 0.09/0.036 | 0.09/0.036 | 0.09/0.036 | 0.09/0.036 |

Table I provides the technical specifications showing the present invention in accordance with Formula F in different weights exceeds the engineer performance requirements of API SJ, SH, SG, SF and previous gasoline categories.

TABLE II

FORMULA "A"
Complete Engine Oil Formula

| Components | Vol % | Range (vol %) |
|---|---|---|
| Polyalphaolefin Base Stock | 17.38 | 1–90 |
| Ester Base Stock | 2.44 | 1–90 |
| Mineral Oil Base Stock | 27.93 | 1–90 |
| Group III (severely hydrocracked semi-synthetic oil) Base Stock | 32.97 | 1–90 |
| LZ8955 Dispersant Inhibitor | 3.14 | 0.5–35 |
| LZ 9802 Dispersant Inhibitor | 7.90 | 0.5–35 |
| Substituted Sulfolane Seal Sweller | 0.25 | 0.05–10 |
| Oil-soluble Molybdenum Additive | 0.46 | 0.05–10 |
| Styrene isoprene Viscosity Index Improver | 6.92 | 0.5–15 |

TABLE II-continued

FORMULA "A"
Complete Engine Oil Formula

| Components | Vol % | Range (vol %) |
|---|---|---|
| Boric acid Compound Corrosion Inhibitor | 0.28 | 0.05–5 |
| Poly-methacyrlate Pour Point Depressant | 0.33 | 0.05–5 |
| | 100.00 | |

TABLE III

FORMULA "B"
Complete Engine Oil Formula

| Components | Vol % | Range (vol %) |
|---|---|---|
| Polyalphaolefin Base Stock and/or Ester Base Stock and/or Mineral Oil Base Stock and/or Group III (Severely Hydrocracked Semi-synthetic Oil) Base Stock | 80.72 | 5–90 |
| LZ8955 Dispersant Inhibitor | 3.14 | 0.5–35 |
| LZ 9802 Dispersant Inhibitor | 7.90 | 0.5–35 |
| Sulfolane Compound | 0.25 | 0.05-10 |
| Oil-soluble Molybdenum Additive | 0.46 | 0.05-10 |
| Styrene isoprene Viscosity Index Improver | 6.92 | 0.5–15 |
| Boric acid Compound Corrosion Inhibitor | 0.28 | 0.05–5 |
| Poly-methacyrlate Pour Point Depressant | 0.33 | 0.05–5 |
| | 100.00 | |

TABLE IV

FORMULA "C"
Complete Engine Oil Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and/or Group V Synthetics (esters, and napthenes) | 80.72 | 5–90 |
| LZ8955 Dispersant Inhibitor | 3.14 | 0.5–35 |
| LZ 9802 Dispersant Inhibitor | 7.90 | 0.5–35 |
| Substituted Sulfolane Seal Sweller | 0.25 | 0.05–10 |
| Oil-soluble Molybdenum Additive | 0.46 | 0.05–10 |
| Styrene isoprene Viscosity Index Improver | 6.92 | 0.5–15 |
| Boric acid Compound Corrosion Inhibitor | 0.28 | 0.05-5 |
| Poly-methacyrlate Pour Point Depressant | 0.33 | 0.05–5 |
| | 100.00 | |

TABLE V

FORMULA "D"
Complete Engine Oil Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and /or Group V Synthetics (esters, and napthenes) | 80.72 | 5–90 |
| Dispersant Inhibitor | 11.04 | 0.5–35 |
| Substituted Sulfolane | 0.25 | 0.05–10 |
| Oil-soluble Molybdenum Additive | 0.46 | 0.05–10 |
| Viscosity Index Improver | 6.92 | 0.5–15 |
| Corrosion Inhibitor | 0.28 | 0.05–5 |
| Pour Point Depressant | 0.33 | 0.05–5 |
| | 100.00 | |

TABLE VI

FORMULA "E"
Complete Engine Oil Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and /or Group V Synthetics (esters, and napthenes) Base Oil | 80.72 | 5–90 |
| A Dispersant Inhibitor | 11.04 | 0.5–35 |
| Substituted Sulfolane and/or phthalate plasticizer and/or dinonly phthalate plasticizer and/or dihexylpthalate plasticizer, and/or, sulfolane and/or a Substituted Sulfolane Seal Sweller | 0.25 | 0.05–10 |
| An oil-soluble Organo Molybdenum and/or sulfonated oxymolybdenum dialkyldithiophosphate, and/or molybdenum dithiocarbamate and/or molybdenum octoage and/or molybdenum sulfide and/or molybdenum oxide | 0.46 | 0.05–10 |
| A polyisobutenes and/or polymethacrylate Acid Esters and/or Diene Polymers and/or Polyolefins and multifunctional viscosity improvers and/or styrene-butadiene rubber in mineral oil and/or A styrene iosprene Viscosity Index Improver | 6.92 | 0.1–15 |
| Borate Ester and/or a Dimercapto and/or a Thiediapoles and/or a Benzotriazole Corrosion Inhibitor | 0.28 | 0.01–5 |
| A polymethacyrlate, alkylated bicyclic aromatics, styrene esters, polyfumerates, oligomerized alky phenols, dialkyl esters of phthalate acid, ethylene vinyl acetate copolymers, and other mixed hydrocarbon polymers Pour Point Depressant | 0.33 | 0.05–5 |
| | 100.00 | |

TABLE VII

FORMULA "F"
Complete Engine Oil Formula

| Components | Vol % | Range (vol %) |
|---|---|---|
| Polyolefins (PA04) | 17.38 | 5–90 |
| Synthetic Esters (M-045) | 2.44 | 5–90 |
| Mineral Oil Base (Ashland 100) | 9.13 | 5–90 |
| Mineral Oil Base (Ashland 325) | 18.80 | 5–90 |
| Yubase-4 (Severe Hydrocracked Group III) | 32.97 | 5–90 |
| Dispersant Inhibitor (LZ8955) | 3.14 | 0.5–35 |
| Dispersant Inhibitor (LZ9802) | 7.90 | 0.5–35 |
| Substituted Sulfolane (LZ 730) | 0.25 | 0.05–10 |

TABLE VII-continued

FORMULA "F"
Complete Engine Oil Formula

| Components | Vol % | Range (vol %) |
|---|---|---|
| Oil-soluble Molybdenum Additive (MOLY 855) | 0.46 | 0.05–10 |
| Viscosity Index Improver (SHELL VIS 260) | 6.92 | 0.5–15 |
| Corrosion Inhibitor Boric Ester MOBILADC700 | 0.28 | 0.05–5 |
| Pour Point Depressant (ACRYLOID 3008) | 0.33 | 0.05–5 |
| | 100.00 | |

CONCENTRATED ADDITICES EXAMPLES

A better understanding of the present invention will be had upon reference to the following examples set forth in Tables VIII–XIII (Formulas G–L) setting forth the compositions of concentrated additives for use with conventional synthetic, mineral oil, or blended motor oils at up to 30% by volume crankcase motor oil.

TABLE VIII

FORMULA "G"
Concentrated Additive Formula

| Components | Vol % | Range (vol %) |
|---|---|---|
| Polyalphaolefin Base Stock | 17.38 | 1–90 |
| Ester Base Stock | 2.44 | 1–90 |
| Mineral Oil Base Stock | 24.96 | 1–90 |
| Group III (severely hydrocracked semi-synthetic oil) Base Stock | 32.97 | 1–90 |
| LZ8955 Dispersant Inhibitor | 3.14 | 0.5–35 |
| LZ 9802 Dispersant Inhibitor | 7.90 | 0.5–35 |
| Substituted Sulfolane Seal Sweller | 1.00 | 0.05–10 |
| Oil-soluble Molybdenum Additive | 1.84 | 0.05–10 |
| Styrene isoprene Viscosity Index Improver | 6.92 | 0.5–15 |
| Boric acid Compound Corrosion Inhibitor | 1.12 | 0.05–5 |
| Poly-methacyrlate Pour Point Depressant | 0.33 | 0.05–5 |
| | 100.00 | |

TABLE IX

FORMULA "H"
Concentrated Additive Formula

| Components | Vol % | Range (vol %) |
|---|---|---|
| Polyalphaolefin Base Stock and/or Ester Base Stock and/or Mineral Oil Base Stock and/or Group III (Severely Hydrocracked Semi-synthetic Oil) Base Stock | 77.75 | 5–90 |
| LZ8955 Dispersant Inhibitor | 3.14 | 0.5–35 |
| LZ 9802 Dispersant Inhibitor | 7.90 | 0.5–35 |
| Pheanate Seal Sweller | 1.00 | 0.05–10 |
| Oil-soluble Molybdenum Additive | 1.84 | 0.05–10 |
| Styrene isoprene Viscosity Index Improver | 6.92 | 0.5–15 |
| Boric acid Compound Corrosion Inhibitor | 1.12 | 0.05–5 |
| Poly-methacyrlate Pour Point Depressant | 0.33 | 0.05–5 |
| | 100.00 | |

TABLE X

FORMULA "I"
Concentrated Additive Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and/or Group V Synthetics (esters, and napthenes) | 77.75 | 5–90 |
| LZ8955 Dispersant Inhibitor | 3.14 | 0.5–35 |
| LZ 9802 Dispersant Inhibitor | 7.90 | 0.5–35 |
| Substituted Sulfolane Seal Sweller | 1.00 | 0.05–10 |
| Oil-soluble Molybdenum Additive | 1.84 | 0.05–10 |
| Styrene isoprene Viscosity Index Improver | 6.92 | 0.5–15 |
| Boric acid Compound Corrosion Inhibitor | 1.12 | 0.05–5 |
| Poly-methacyrlate Pour Point Depressant | 0.33 | 0.05–5 |
| | 100.00 | |

TABLE XI

FORMULA "J"
Concentrated Additive Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and /or Group V Synthetics (esters, and napthenes) | 77.75 | 5–90 |
| Dispersant Inhibitor | 11.04 | 0.5–35 |
| Substituted Sulfolane | 1.00 | 0.05–10 |
| Oil-soluble Molybdenum Additive | 1.84 | 0.05–10 |
| Viscosity Index Improver | 6.92 | 0.5–15 |
| Corrosion Inhibitor | 1.12 | 0.05–5 |
| Pour Point Depressant | 0.33 | 0.05–5 |
| | 100.00 | |

TABLE XII

FORMULA "K"
Concentrated Additive Formula

| Components | Vol % | Range (vol %) |
|---|---|---|
| Group I (solvent refined mineral oils) and/or Group II (hydrocracked mineral oils) and/or Group III (severely hydrocracked oil) and/or Group IV Synthetics including (polyolefins) and /or Group V Synthetics (esters, and napthenes) Base Oil | 77.75 | 5–90 |
| At least one Dispersant Inhibitor | 11.04 | 0.5–35 |
| Substituted Sulfolane and/or phthalate plasticizer and/or dinonly phthalate plasticizer and/or dihexylpthalate plasticizer, and/or, sulfolane and/or a Substituted Sulfolane Seal Sweller | 1.00 | 0.05–10 |
| An oil-soluble Organo Molybdenum and/or sulfonated oxymolybdenum dialkyldithiophosphate, and/or molybdenum dithiocarbamate and/or molybdenum octoage and/or molybdenum sulfide and/or molybdenum oxide | 1.84 | 0.05-10 |
| A polyisobutenes and/or polymethacrylate Acid Esters and/or Diene Polymers and/or Polyolefins and multifunctional viscosity improvers and/or styrene-butadiene rubber in mineral oil and/or A styrene iosprene Viscosity Index Improver | 6.92 | 0.1–15 |

TABLE XII-continued

| FORMULA "K" Concentrated Additive Formula | | |
|---|---|---|
| Components | Vol % | Range (vol %) |
| Borate Ester and/or a Dimercapto and/or a Thiediapoles and/or a Benzotriazole Corrosion Inhibitor | 1.12 | 0.01–5 |
| A polymethacyrlate, alkylated bicyclic aromatics, styrene esters, polyfumerates, oligomerized alky phenols, dialkyl esters of phthalate acid, ethylene vinyl acetate copolymers, and other mixed hydrocarbon polymers Pour Point Depressant | 0.33 | 0.05–5 |
| | 100.00 | |

TABLE XIII

| FORMULA L (Formula A Concentrate" Complete Engine Oil Formula | | |
|---|---|---|
| Components | Vol % | Range (vol %) |
| Polyolefins (PA04) | 17.38 | 5–90 |
| Synthetic Esters (M-045) | 2.44 | 5–90 |
| Mineral Oil Base (Ashland 100) | 8.13 | 5–90 |
| Mineral Oil Base (Ashland 325) | 16.83 | 5–90 |
| Yubase-4 (Severe Hydrocracked Group III) | 32.97 | 5–90 |
| Dispersant Inhibitor (LZ8955) | 3.14 | 0.5–35 |
| Dispersant Inhibitor (LZ9802) | 7.90 | 0.5–35 |
| Substituted Sulfolane (LZ 730) | 1.00 | 0.05–10 |
| Oil-soluble Molybdenum Additive (MOLY 855) | 1.84 | 0.05–10 |
| Viscosity Index Improver (SHELL VIS 260) | 6.92 | 0.5–15 |
| Corrosion Inhibitor Boric Ester MOBILADC700 | 1.12 | 0.05–5 |
| Pour Point Depressant (ACRYLOID 3008) | 0.33 | 0.05–5 |
| | 100.00 | |

Experimental Results

As best illustrated in the drawings, FIG. 1 shows the present invention as set forth in Formula F exhibits superior oil consumption performance when tested in a new 2000 Buck 3.8 L engine under extreme highway driving conditions. Improved performance was also exhibited after the engine was aged with conventional oil, then switched to the Formula F composition. The results were verified by running actual cars on a dynamometer.

Figure 2:
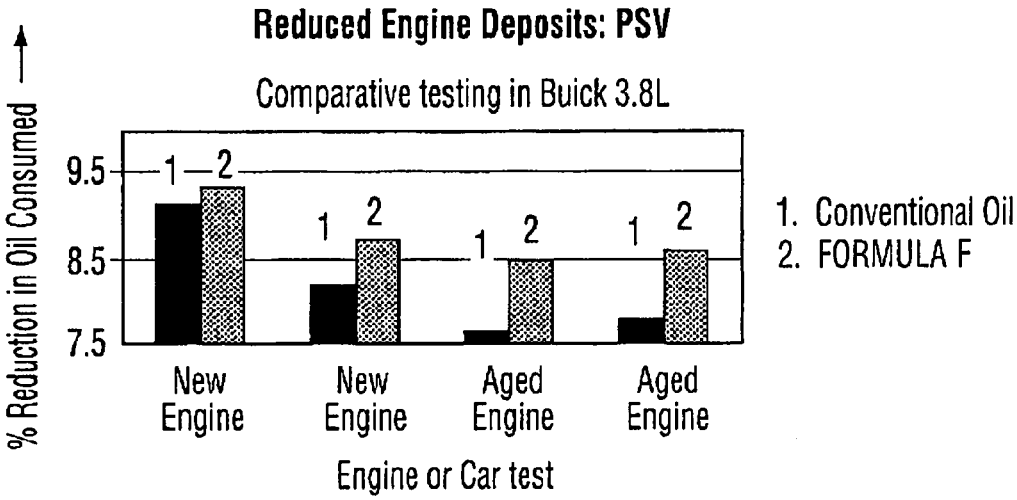
FIG. 2 is a graph showing reduced engine deposits using the motor oil composition of the present invention.

FIG. 2 shows improved deposit control properties as compared to a conventional oil when tested in a new 2000 Buick 3.8 L engine under extreme highway driving conditions. Improved performance was also exhibited after the engine was aged with conventional oil, then switched to the Formula F composition.

Figure 3:
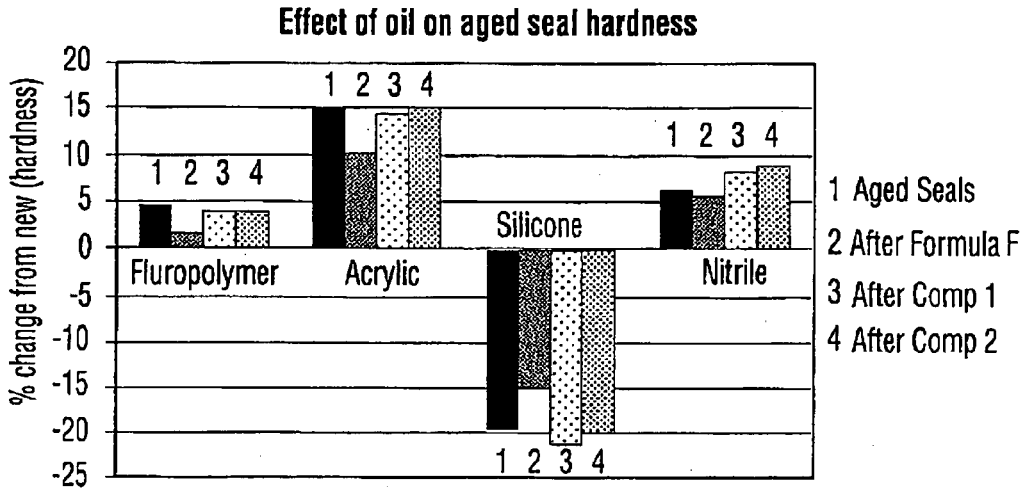
FIG. 3 is a graph showing the effect of oil on aged seal hardness.

FIG. 3 is a graph showing the seal conditioning properties of the composition of Formula F. The seal performance tends to deteriorate with use and aging. They tend to harden or soften affecting their performance. In the test results shown in FIG. 3, the seals were treated with conventional oil at elevated temperatures over a period of time causing them to harden/soften. Formula F, as shown above, has a greater ability to bring the seals to their original state (desired hardness) as compared to conventional oils.

Figure 4:
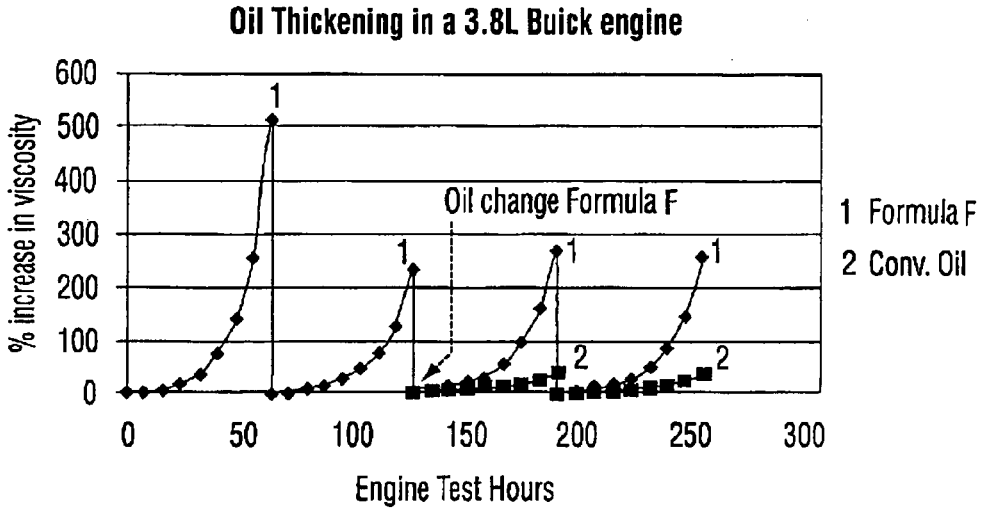
FIG. 4 is a graph showing the effect of oil thickening.

As shown in the graph depicted in FIG. 4, oil thickening occurs due to oil tending to oxidize and thicken with age. The oil should resisting thermal breakdown and exhibit good viscosity control. As shown in the graph, the Formula F composition developed with unique additives slow down the oxidation process reducing oil thickening.

Figure 5:
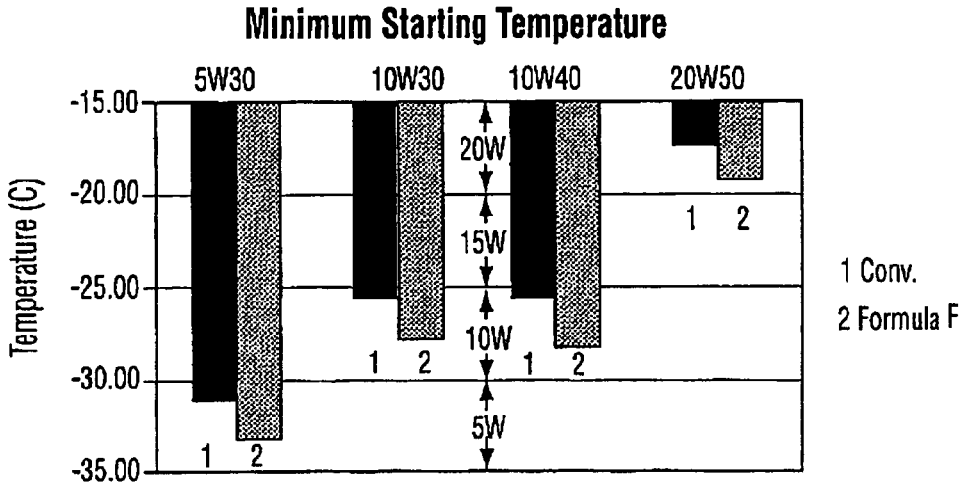
FIG. 5 is a graph showing the effects of minimum starting temperature of an formulated in accordance with the present invention.

FIG. 5 shows a graph whereby Formula F is formulated with premium base stocks having superior low temperature properties as compared to conventional oils enabling the engine to start at lower temperatures, within the specified limits of it's viscosity grade. Of course, for the lowest starting temperature use Formula in the 5W-30 weight.

FIG. 6 is a bar chart of ASTM D4172 four-ball wear results versus lube compositions.

Experimental Evaluation

The foregoing Examples provide the results of tests performed comparing the synergistic combination of formula components of the present invention with conventional motor oil having a synthetic, mineral oil, or blend base. The Examples exemplify the technology previously described. The synergistic combination of the formula components in the Examples provide excellent performance at high temperatures while also maintaining excellent performance at moderately elevated temperatures and normal temperatures, as well as provide resistance to ferrous and copper corrosion, improved wear, oxidation resistance, viscosity stability, engine cleanliness, fuel economy, cold starting, inhibition of acid formation, and other desirable high performance properties greater than exhibited by the individual components. The improved performance of the engine additive in comparison with conventional mineral oil crankcase lubricants is attributable to optimizing the design parameters for each of the individual chemical constituents and combining the chemical constituents according to the present invention.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature cited are expressly incorporated herein by reference, including any patents or other literature references cited within such documents as if fully set forth in this specification.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. An engine crankcase lubricant, comprising:

an effective amount of a base oil selected from the group consisting of Group I solvent refined mineral oils, Group II hydrocracked mineral oils, Group III severely hydrocracked oils or combinations thereof;

an effective amount of a synthetic base oil selected from Group IV synthetic polyolefins, Group V synthetic oils comprising esters and napthenes, or combinations thereof;

an effective amount of a dispersant inhibitor;

an effective amount of a seal swelling agent selected from the group consisting of substituted sulfolane, phthalate plasticizer, dinonly phthalate plasticizer, dihexylpthalate plasticizer, sulfolanes, phenates, and combinations thereof;

an effective amount of a molybdate compound selected from the group consisting of an oil soluble organo molybdenum, a sulfonated oxymolybdenum dialkydithiophosphate, a molybdenum dithiocarbamate, a molybdenum octoate, a molybdenum sulfide, and a molybdenum oxide;

an effective amount of a viscosity improver selected from the group consisting of a polyisobutene, a polymethacrylate acid esters, a diene polymer, a polyolefin, a multifunctional viscosity diene polymer, a polyolefin and multifunctional viscosity improver, a styrene-butadiene rubber in mineral oil, a styrene isoprene viscosity improver, and combinations thereof;

an effective amount of a corrosion inhibitor selected from the group consisting of a borate ester, a dimercapto, a benzotriazole, a triazole and combinations thereof; and an effective amount of a pour point depressant selected from the group consisting of a polymethacrylate, an alkylated bicyclic aromatic, a styrene ester, a polyfumerate, an oligomerized alkyl phenol, a dialky ester of phthalate acid, an ethylene vinyl acetate copolymer, and other mixed hydrocarbon polymers.

2. An engine crankcase lubricant, comprising:

an effective amount of a base oil selected from the group consisting of Group I solvent refined mineral oils, Group II hydrocracked mineral oils, Group III severely hydrocracked oils or combinations thereof;

an effective amount of a synthetic base oil selected from Group IV synthetic polyolefins, Group V synthetic oils comprising esters and napthenes, or combinations thereof;

an effective amount of a dispersant inhibitor;

an effective amount of a seal swelling agent selected from the group consisting of substituted sulfolane, phthalate plasticizer, dinonly phthalate plasticizer, dihexylpthalate plasticizer, sulfolanes, phenates, and combinations thereof;

an effective amount of a molybdate compound selected from the group consisting of an oil soluble organo molybdenum, a sulfonated oxymolybdenum dialkydithiophosphate, a molybdenum dithiocarbamate, a molybdenum octoate, a molybdenum sulfide, and a molybdenum oxide;

an effective amount of a viscosity improver selected from the group consisting of a polyisobutene, a polymethacrylate acid esters, a diene polymer, a polyolefin, a multifunctional viscosity diene polymer, a polyolefin and multifunctional viscosity improver, a styrene-butadiene rubber in mineral oil, a styrene isoprene viscosity improver, and combinations thereof; and an effective amount of a pour point depressant selected from the group consisting of a polymethacrylate, an alkylated bicyclic aromatic, a styrene ester, a polyfumerate, an oligomerized alkyl phenol, a dialky ester of phthalate acid, an ethylene vinyl acetate copolymer, and other mixed hydrocarbon polymers.

* * * * *